US012128935B2

(12) United States Patent
Pu et al.

(10) Patent No.: US 12,128,935 B2
(45) Date of Patent: Oct. 29, 2024

(54) TRAIN SUSPENSION DEVICE AND SUSPENDED MONORAIL TRAIN

(71) Applicant: CRRC ZHUZHOU LOCOMOTIVE CO., LTD., Hunan (CN)

(72) Inventors: Quanwei Pu, Hunan (CN); Longjiang Shen, Hunan (CN); Xiaoyan Li, Hunan (CN); Xinpeng Zhou, Hunan (CN); Bin Gao, Hunan (CN); Yulong Liu, Hunan (CN); Wentao Zhang, Hunan (CN); Han Luo, Hunan (CN); Qingsheng Guo, Hunan (CN); Jianhui Jiang, Hunan (CN); Ti Xiao, Hunan (CN); Pingping Wang, Hunan (CN); Wei Zeng, Hunan (CN)

(73) Assignee: CRRC ZHUZHOU LOCOMOTIVE CO., LTD., Hunan (CN)

( * ) Notice: Subject to any disclaimer, the term of this patent is extended or adjusted under 35 U.S.C. 154(b) by 881 days.

(21) Appl. No.: 17/282,387

(22) PCT Filed: Sep. 11, 2019

(86) PCT No.: PCT/CN2019/105378
§ 371 (c)(1),
(2) Date: Apr. 2, 2021

(87) PCT Pub. No.: WO2020/140475
PCT Pub. Date: Jul. 9, 2020

(65) Prior Publication Data

US 2021/0387656 A1 Dec. 16, 2021

(30) Foreign Application Priority Data

Jan. 2, 2019 (CN) ..... 201910002223.4

(51) Int. Cl.
*B61F 5/12* (2006.01)
*B61B 3/00* (2006.01)
(Continued)

(52) U.S. Cl.
CPC ..... *B61F 5/125* (2013.01); *B61B 3/00* (2013.01); *B61B 3/02* (2013.01); *B61B 13/04* (2013.01); *B61F 5/08* (2013.01); *B61F 5/305* (2013.01)

(58) Field of Classification Search
CPC ... B61B 3/00; B61B 3/02; B61B 13/04; B61F 5/02; B61F 5/04; B61F 5/08; B61F 5/12; B61F 5/125; B61F 5/26; B61F 5/305
See application file for complete search history.

(56) References Cited

U.S. PATENT DOCUMENTS

2014/0306387 A1 10/2014 Kreuzweger
2017/0001651 A1 1/2017 Distler et al.
2017/0050648 A1 2/2017 Quinn

FOREIGN PATENT DOCUMENTS

CN 103523038 A 1/2014
CN 103764475 A 4/2014
(Continued)

OTHER PUBLICATIONS

International Search Report for PCT/CN2019/105378 mailed Nov. 28, 2019, ISA/CN.

*Primary Examiner* — Zachary L Kuhfuss
*Assistant Examiner* — Heaven R Buffington
(74) *Attorney, Agent, or Firm* — Yue (Robert) Xu; Apex Attorneys at Law, LLP

(57) ABSTRACT

A bolster beam is correspondingly connected to a connection base by means of a damping unit; the radial dimensions of an outer wall of an inner supporting member and an inner wall of an outer supporting member gradually decrease from
(Continued)

one end to the other end in a vertical direction; one of the inner supporting member and the outer supporting member is connected to the connection base, and the other one is connected to the bolster beam; when in use, the inner supporting member and the outer supporting member tend to be close to each other, and since surfaces, close to each other, of the two are configured to be tapered, the two can-not be relatively separated; when getting closer to each other, the inner supporting member and the outer supporting member produce a compression action on an intermediate buffer member, and the intermediate buffer member is elastically deformable.

12 Claims, 7 Drawing Sheets

(51) Int. Cl.

| | |
|---|---|
| ***B61B 3/02*** | (2006.01) |
| ***B61B 13/04*** | (2006.01) |
| ***B61F 5/08*** | (2006.01) |
| ***B61F 5/30*** | (2006.01) |

(56) References Cited

FOREIGN PATENT DOCUMENTS

| | | | | | |
|---|---|---|---|---|---|
| CN | 104913001 | A | | 9/2015 | |
| CN | 205905987 | U | | 1/2017 | |
| CN | 106364512 | A | | 2/2017 | |
| CN | 206017526 | U | | 3/2017 | |
| CN | 108162987 | A | | 6/2018 | |
| CN | 108216287 | A | | 6/2018 | |
| CN | 207617731 | U | | 7/2018 | |
| CN | 109017854 | A | | 12/2018 | |
| CN | 109017856 | A | | 12/2018 | |
| CN | 109532912 | A | | 3/2019 | |
| DE | 112016007394 | T5 | * | 7/2019 | ..... B61B 13/06 |
| JP | 2009068514 | A | | 4/2009 | |
| RU | 2201878 | C2 | | 4/2003 | |
| WO | 2010010810 | A1 | | 1/2010 | |

* cited by examiner

TRAIN SUSPENSION DEVICE AND SUSPENDED MONORAIL TRAIN

The present application is a National Phase entry of PCT Application No. PCT/CN2019/105378, filed on Sep. 11, 2019, which claims priority to Chinese Patent Application No. 201910002223.4, titled "TRAIN SUSPENSION DEVICE AND SUSPENDED MONORAIL TRAIN", filed on Jan. 2, 2019 with the China National Intellectual Property Administration, which are incorporated herein by reference in their entireties.

TECHNICAL FIELD

The present application relates to the technical field of rail vehicles, and in particular to a train suspension device. In addition, the present application also relates to a suspended monorail train.

BACKGROUND

A suspended monorail train is a special rail transit train, which is different from a conventional steel-wheeled rail transit train supporting a train body from below through steel rail. A bogie of the suspended monorail train is located above the train body, and the train body is suspended below the bogie. The suspended monorail train is suitable for an area where the geographical and climatic condition do not have the ability to build a light rail and a subway system, and may also be used as auxiliary branches for an urban rail transit line or a tourist-affected sightseeing line.

As shown is FIG. 1A, it is a structural diagram of a suspended monorail train. A suspension device 02 is the only force transmission component between a train body 03 and a bogie 01. The force transmission in the three directions between the train body 03 and the bogie 01 and the relative movement between the two are completed by the suspension device 02, which concerns the running safety and riding comfort of the train.

Since the train body 03 is located below the bogie 01, and the train body 03 is suspended in the air, main equipment on the train body is arranged on a top of the train body, and a space of the top of the train body is limited. As shown in FIG. 1B, it is a conventional train body suspension structure diagram. The suspension device 02 and a bolster seam 04 on the train body 03 are rigidly connected by bolts 05, as shown in FIG. 1B, four bolts 05 are arranged to fix the suspension device 02 and the bolster seam 04 as a whole. The rigid connection may cause the vibration on the bogie to be directly transmitted to the train body, which affects the riding experience; the noise is transmitted to the train body through the bolts, which adds the noise of the train body.

For those skilled in the art, the technical problem to be solved by those skilled in the art is how to reduce the vibration and noise level of the train body at present.

SUMMARY

The present application provides a train suspension device, which realizes the function of damping vibration and reducing noise through a damping unit, and the specific solution is as follows:

a train suspension device includes a hoisting rod and a connection base, and a top of the hoisting rod is connected to a bogie, and a bottom is arranged on the connection base;

a damping unit for connecting a bolster seam with the connection base, includes an inner supporting member, an intermediate buffer member and an outer supporting member nested successively from inside to outside, radial dimensions of an outer wall of the inner supporting member and an inner wall of the outer supporting member gradually decrease from one end to the other end in a vertical direction, and the intermediate buffer member, which is elastically deformable, is clamped between the inner supporting member and the outer supporting member;

one of the inner supporting member and the outer supporting member is connected to the connection base, and the other one of the inner supporting member and the outer supporting member is connected to the bolster seam, so that the inner supporting member and the outer supporting member have a tendency of approaching each other.

Optionally, a vertically through supporting hole is defined on the connection base, and the supporting hole limits the installation of the outer supporting member; the radial dimensions of the outer wall of the inner supporting member and the inner wall of the outer supporting member gradually decrease from top to bottom; the inner supporting member is fixed relative to the bolster seam.

Optionally, an annular supporting plate is arranged at a bottom of the supporting hole, and the supporting plate supports the outer supporting member from the bottom.

Optionally, an inner wall of the supporting hole is perpendicular to a horizontal plane; the inner wall of the supporting hole is provided with a supporting step, and the supporting step is configured for cooperating with and supporting an outer step protruding from an outer surface of the outer supporting member.

Optionally, a coupling cylinder is arranged on the bolster seam, and an internal thread is provided on an inner wall of the coupling cylinder, and the coupling cylinder is fixedly connected to the inner supporting member through a threaded connection.

Optionally, a cover plate is arranged on and covers a top of the inner supporting member, and a coupling bolt penetrates a middle of the cover plate, and a stud of the coupling bolt is inserted into the internal thread of the coupling cylinder.

Optionally, a top of the coupling cylinder is higher than an upper surface of the bolster seam, and a limit ring protrudes downwardly around a through hole in a center at a bottom of the inner supporting member, and the limit ring is configured to be inserted into the coupling cylinder;

an upper contact surface at the top of the coupling cylinder and a lower contact surface at the bottom of the inner supporting member are mutually matched finishing surfaces.

Optionally, a distance between the upper surface of the bolster seam and a lower surface of the connection base is 5 mm to 10 mm; the coupling cylinder is fixed to the bolster seam by welding, and a bottom of an outer surface of the coupling cylinder is arranged with an annular convex edge, which supports a lower surface of the bolster seam.

Optionally, a limit platform protrudes downwardly from a middle of a bottom of the cover plate, and the limit platform is inserted into an inner cavity of the inner supporting member, and configured to contact an inner wall of the inner supporting member to limit.

Optionally, the intermediate buffer is in a shape of a cone, and the outer surface of the inner supporting member and the inner surface of the outer supporting member are tapered surfaces.

Optionally, the intermediate buffer is made of rubber, and the inner supporting member, the intermediate buffer and the outer supporting member are vulcanized into one body.

The intermediate buffer is in a shape of an annular step, and the outer surface of the inner supporting member and the inner surface of the outer supporting member are step surfaces which are pressed tightly with the intermediate buffer.

The present application also provides a suspended monorail train, including any one of the above train suspension devices.

The present application provides the train suspension device, the top of the hoisting rod is connected to the bogie, and the bottom is arranged on the connection base; the bolster seam and the connection base are relatively connected by the damping unit, and the damping unit includes the inner supporting member, the intermediate buffer member and the outer supporting member nested successively from inside to outside, the radial dimensions of the outer wall of the inner supporting member and the inner wall of the outer supporting member gradually decrease from one end to the other end in the vertical direction, one of the inner supporting member and the outer supporting member is connected to the connection base, and the other one of the inner supporting member and the outer supporting member is connected to the bolster seam, so that the inner supporting member and the outer supporting member have a tendency of approaching each other, and since surfaces approaching each other of the inner supporting member and the outer supporting member are tapered, the inner supporting member and the outer supporting member cannot be relatively separated; when getting closer to each other, the inner supporting member and the outer supporting member produce a compression action on the intermediate buffer member, and the intermediate buffer member is elastically deformable, and has a buffering function when the inner supporting member and the outer supporting member impact on each other; and the connection base is not directly fixedly connected to the bolster beam, having an insulation effect on vibration and noise from the bogie, thereby improving the riding comfort of the train body.

The present application also provides a suspended monorail train, which can realize the same technical effect.

BRIEF DESCRIPTION OF THE DRAWINGS

For more clearly illustrating embodiments of the present application or the technical solutions in the conventional technology, drawings to be used in the description of the embodiments or the conventional technology will be briefly described hereinafter. Apparently, the drawings in the following description are only some embodiments of the present application. For those skilled in the art, other drawings may be obtained based on the provided drawings without any creative work.

In figures.

Figure 1A:
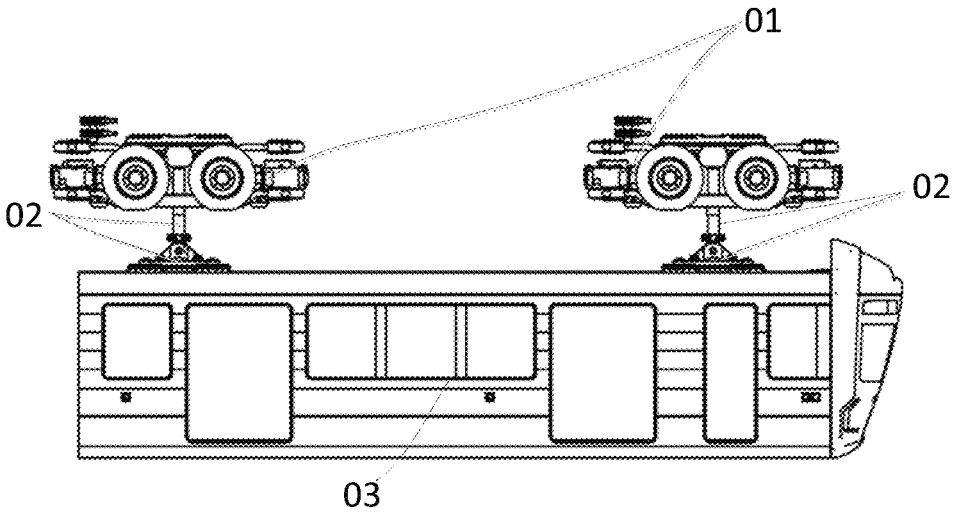
Figure 1A Prior Art
FIG. 1A is a structural diagram of a suspension monorail train.
Figure 1B:
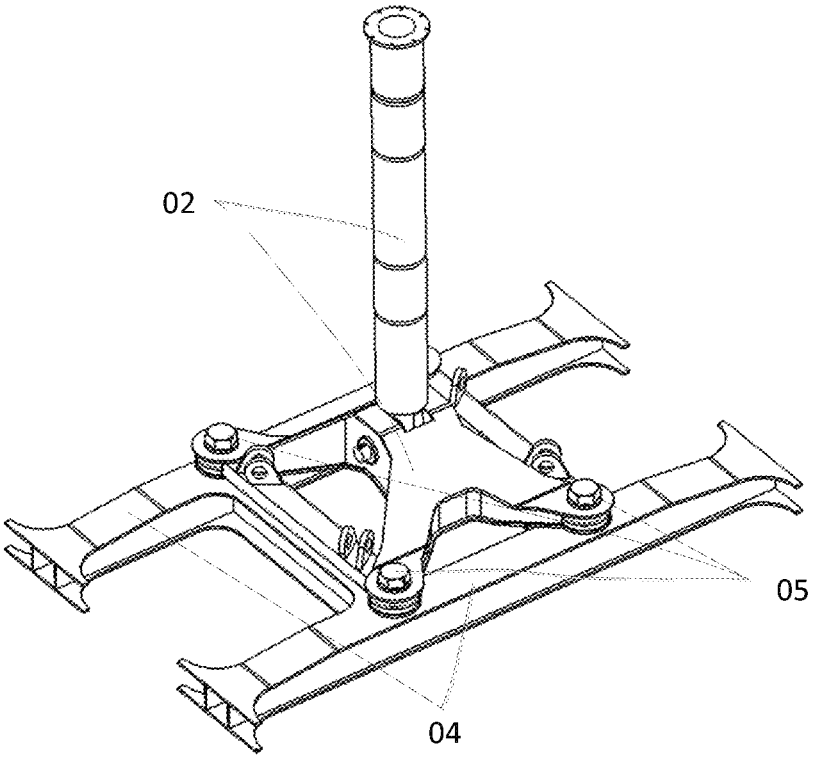
Figure 1B Prior Art
FIG. 1B is a conventional train body suspension structure diagram.

hoisting rod 1, connection base 2, supporting hole 21, supporting plate 22, supporting step 23, damping unit 3, inner supporting member 31, limit ring 311, lower contact surface 312, intermediate buffer member 32, outer supporting member 33, outer step 331, bolster seam 4, coupling cylinder 41, upper contact surface 411, cover plate 51, coupling bolt 52.

DETAILED DESCRIPTION OF THE EMBODIMENTS

The core of the present application is to provide a train suspension device, which realizes damping vibration and reducing noise through a damping unit.

In order to enable those skilled in the art to better understand the technical solutions of the present application, the train suspension device and the suspended monorail train according to the present application will be further described in detail below with reference to the drawings and the specific embodiments.

Figure 2A:
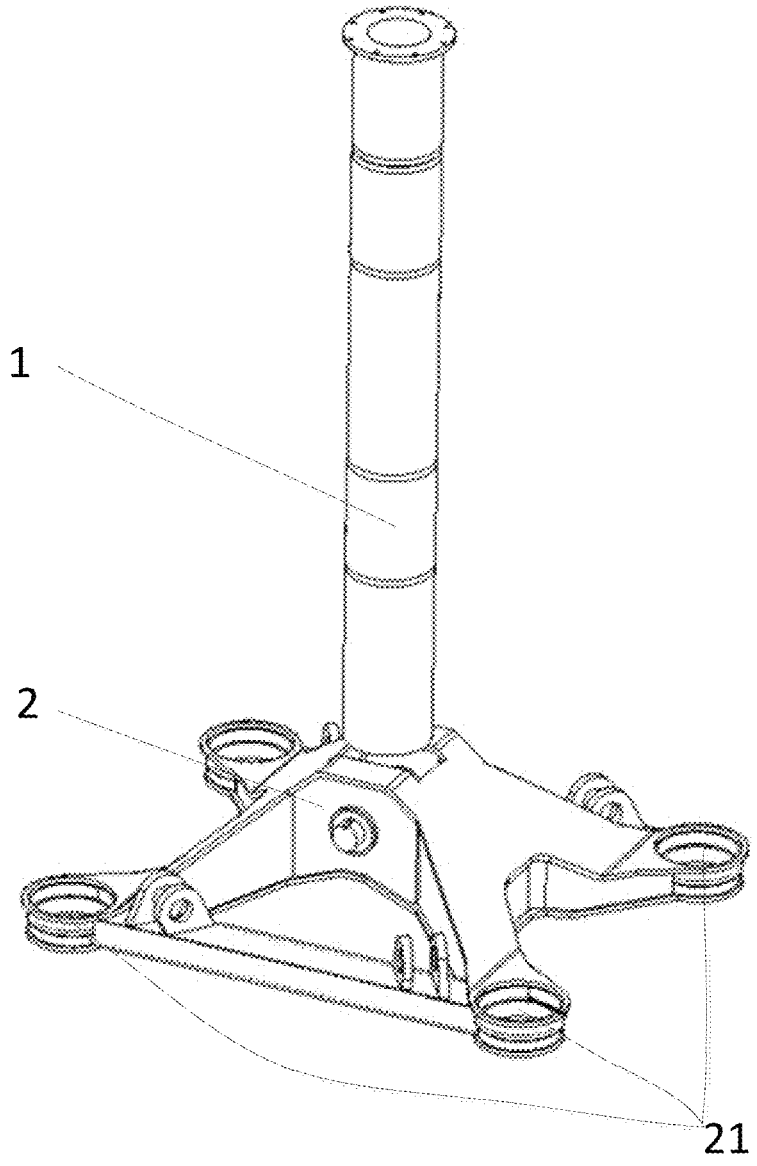
FIG. 2A is a structural diagram of a hoisting rod and a connection base in a train suspension device provided according to the present application.
Figure 2B:
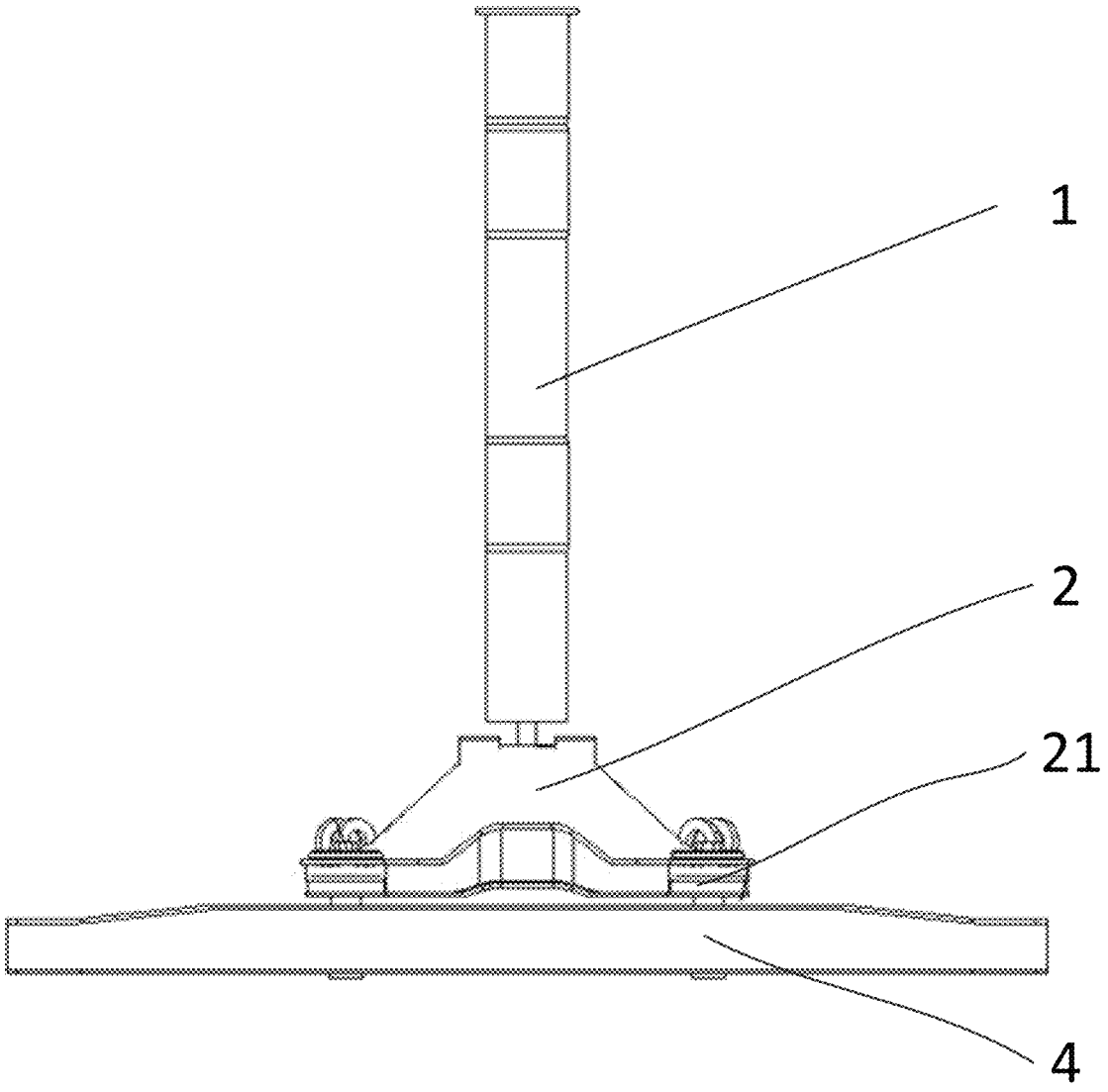
FIG. 2B is a structural diagram of the mutual assembly of a hoisting rod, a connection base, and a bolster seam.

The train suspension device provided according to the present application includes a hoisting rod 1 and a connection base 2, as shown in FIG. 2A. FIG. 2A is a structural diagram of the hoisting rod 1 and the connection base 2 in the train suspension device provided according to the present application. The hoisting rod 1 is arranged vertically, a top of the hoisting rod 1 is connected to a bogie, and the hoisting rod 1 is driven by the bogie to generate a displacement, a bottom of the hoisting rod 1 is provided with the connection base 2, and the connection base 2 is relatively connected with a bolster seam 4, as shown in FIG. 2B. FIG. 2B is a structural diagram of the mutual assembly of the hoisting rod 1, the connection base 2, and the bolster seam 4, and the bolster seam 4 is hoisted through the connection base 2; the hoisting rod 1 and the connection base 2 may be hinged to each other, or fixedly connected, all these connection forms should be protected by the present application; as shown in FIG. 2A, the connection base 2 has four branches, and has four connection positions with the bolster seam 4. The present application is not limited to four branches, and more branches may be arranged or a whole block structure is used for connecting with the bolster seam 4.

A damping unit 3 is configured to connect the bolster seam 4 with the connection base 2, in order to realize a non-rigid connection between the bolster seam 4 and the connection base 2. As shown in 3A, it is a cross-sectional structure diagram of the connection between the bolster seam 4 and the connection base 2 through the damping unit 3. The damping unit 3 includes an inner supporting member 31, an intermediate buffer member 32 and an outer supporting member 33 nested successively from inside to outside, and the inner supporting member 31 and the outer supporting member 33 are made of hard materials and have sufficient rigidity, and are made of metal, such as steel materials; radial dimensions of an outer wall of the inner supporting member 31 and an inner wall of the outer supporting member 33 gradually decrease from one end to the other end in a vertical direction. The description is given in a direction which the damping unit and the connection base 2 are assembled with each other, the radial dimensions of the outer wall of the inner supporting member 31 and the inner wall of the outer supporting member 33 may be gradually decreased from top to bottom, or from bottom to top; there are two cases here, which will be described in detail in the following text; in this article, the inner wall refers to the inner supporting member 31 and the outer supporting member 33 separately, the inner wall is close to the center, and the outer wall is away from the center.

The intermediate buffer member 32 may be elastically deformed, and deformed after being squeezed, and restored to the original size after the external force is removed; the intermediate buffer member 32 is clamped between the inner supporting member 31 and the outer supporting member 33, which buffers the impact force between the inner supporting member 31 and the outer supporting member 33, thereby preventing the inner supporting member 31 and the outer supporting member 33 from directly contacting and causing an impact.

Figure 4A:
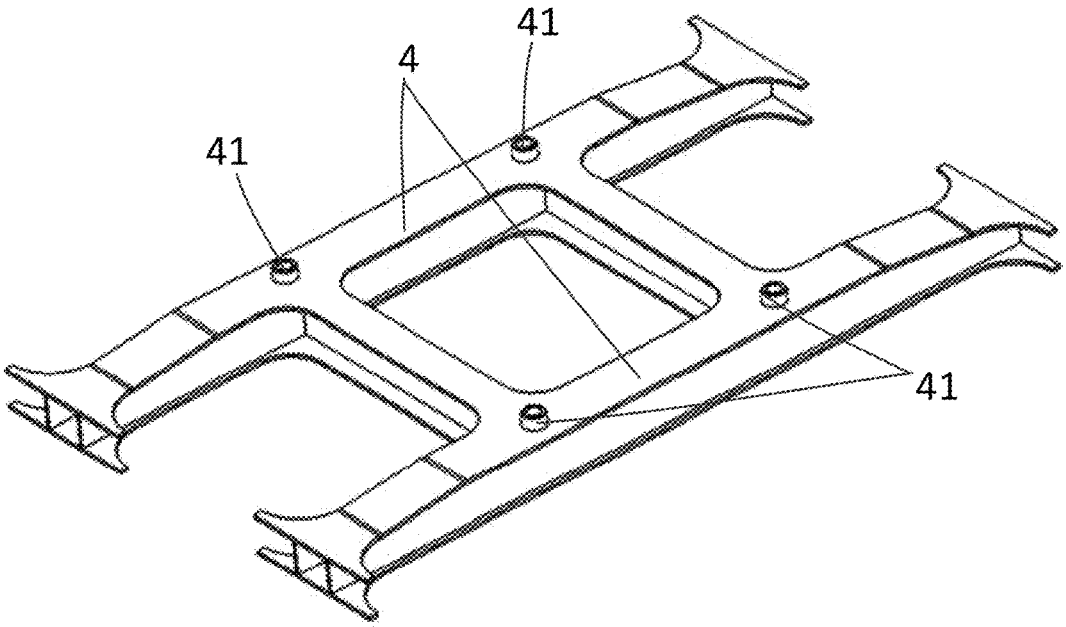
FIG. 4A is an axonometric diagram of a bolster seam.

One of the inner supporting member 31 and the outer supporting member 33 is connected to the connection base 2, and the other one of the inner supporting member 31 and the outer supporting member 33 is connected to the bolster seam 4, and the bolster seam 4 is a structure connected to the top of the train body, as shown in FIG. 4A. FIG. 4A is an axonometric diagram of the bolster seam 4. The present application takes a H-shaped bolster seam as an example; after the assembly is completed, a downward gravity is generated in a structure connected to the bolster seam 4, and the gravity is transmitted to the connection base 2 by the damping unit 3; the inner supporting member 31 and the outer supporting member 33 in the damping unit 3 generates interaction force, and the inner supporting member 31 and the outer supporting member 33 have a tendency of approaching each other, which generates a compression effect on the intermediate buffer member 32.

The elastically deformable intermediate buffer 32 is arranged between the inner supporting member 31 and the outer supporting member 33. When the inner supporting member 31 and the outer supporting member 33 are impacted and produce relative movement, the vertical and lateral forces may be buffered by the intermediate buffer 32, which prevents the inner supporting member 31 and the outer supporting member 33 from vibration and noise caused by the relative impact; since the intermediate buffer 32 may be elastically deformable, it has a great sound attenuation effect, and the noise transmitted from the hoisting rod 1 and the connection base 2 to the bolster seam 4 is greatly reduced. If only to reduce noise, the intermediate buffer 32 may also be made of a rigid sound-absorbing material.

Figure 3A:
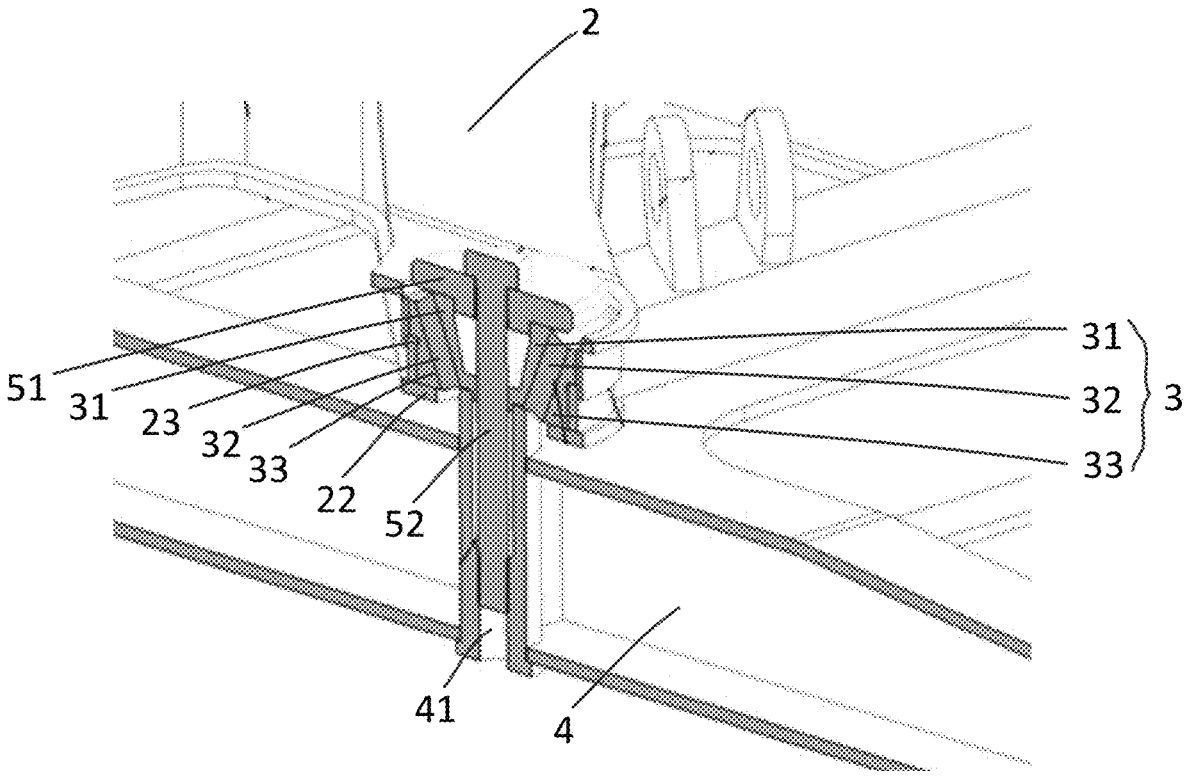
FIG. 3A is a cross-sectional structure diagram of the connection between a bolster seam and a connection base through a damping unit.

On the basis of the above solution, the present application provides a specific arrangement form. A vertically through supporting hole 21 is defined on the connection base 2, and the supporting hole 21 is configured to limit the installation of the outer supporting member 33, the supporting hole 21 defines a position of the outer supporting member 33 and provides a support for the outer supporting member 33; the inner supporting member 31 is relatively fixed to the bolster seam 4. In this solution, the outer supporting member 33 is connected to the connection base 2, and the inner supporting member 31 is connected to the bolster seam 4, the radial dimensions of the outer wall of the inner supporting member 31 and the inner wall of the outer supporting member 33 gradually decrease from top to bottom; the inner supporting member 31 is relatively fixed to the bolster seam 4, as shown in FIG. 3A. The bolster seam 4 generates a downward pulling force on the inner supporting member 31, and the inner supporting member 31 has a tendency of moving downward. Since the radial dimension of the inner wall of the outer supporting member 33 decreases from top to bottom, the outer supporting member 33 supports the inner supporting member 31 and the inner supporting member 31 cannot fall.

The present application also includes that, the radial dimensions of the outer wall of the inner supporting member 31 and the inner wall of the outer supporting member 33 gradually decrease from bottom to top, and the drawings are not provided in this article. It is conceivable that, at this time, the outer supporting member 33 is relatively connected to the bolster seam 4, and the outer supporting member 33 bears the downward gravity of the bolster seam 4, and the inner supporting member 31 is connected to the upper connection base 2. Since the radial dimension of the outer surface of the inner supporting member 31 gradually increases from top to bottom, the outer supporting member 33 can be prevented from falling. This connection form can achieve the same technical effect, therefore, both arrangement forms should be included in the protection scope of the present application.

Further, in the present application, an annular supporting plate 22 is arranged at a bottom of the supporting hole 21, and the supporting plate 22 supports the outer supporting member 33 from the bottom. As shown in FIG. 3A, the supporting plate 22 may be made of an annular metal plate. The opening in a middle of the supporting plate 22 is smaller than the bottom of the outer supporting member 33, and the bottom of the outer supporting member 33 is in contact with a top of the supporting plate 22, which provides support for the outer supporting member 33.

Figure 3B:
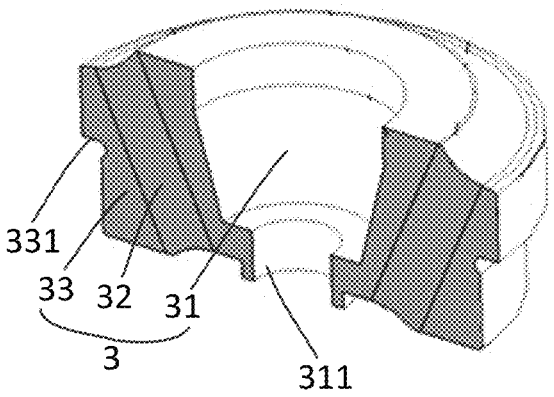
FIG. 3B is a sectional axonometric diagram of a damping unit from one angle.
Figure 3C:
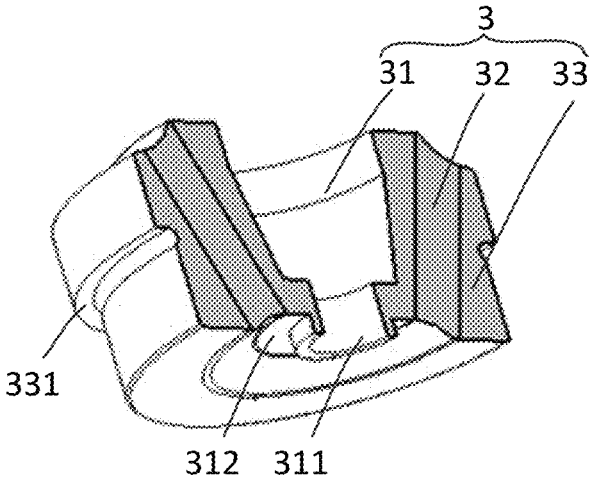
FIG. 3C is a sectional axonometric diagram of a damping unit from another angle.

Preferably, an inner wall of the supporting hole 21 according to the present application is perpendicular to a horizontal plane, that is, the supporting hole 21 may be formed by bending steel pate to facilitate process and manufacture; the inner wall of the supporting hole 21 is provided with a supporting step 23, as shown in FIG. 3A. An inner diameter of the supporting hole 21 above the supporting step 23 is greater than a lower part of the supporting hole 21, which is equivalent to arrange a circle of boss protruding inward on the lower part of the supporting hole 21; as shown in FIGS. 3B and 3C. FIGS. 3B and 3C are sectional axonometric diagrams of the damping unit 3 from two different angles, an outer step 331 protrudes from an outer surface of the outer supporting member 33, which is equivalent to a circle of bump protruding outward on an upper part of the outer supporting member 33, and the supporting step 23 is configured for cooperating with and supporting the outer step 331 protruding from the outer surface of the outer supporting member 33. It is conceivable that the supporting step 23 or the outer step 331 of the inner wall of the supporting hole 21 may also adopt a split structure, and these specific arrangements should be included in the protection scope of the present application.

A coupling cylinder 41 is arranged on the bolster seam 4, the coupling cylinder 41 may be fixed relative to the bolster seam 4, or may be movably connected, and the coupling cylinder 41 should be able to support the bolster seam 4; an internal thread is arranged on an inner wall of the coupling cylinder 41, and is fixedly connected to the inner supporting member 31 through a threaded connection.

A cover plate 51 is arranged on and covers a top of the inner supporting member 31, as shown in FIG. 3A, an opening is defined in a middle of the cover plate 51, and a coupling bolt 52 penetrates the middle of the cover plate 51, and the coupling bolt 52 passes through the opening from top to bottom, and a stud of the coupling bolt 52 is inserted into the internal thread of the coupling cylinder 41, and a bolt head of the coupling bolt 52 is blocked and restricted by the opening on the cover plate 51.

Figure 4B:
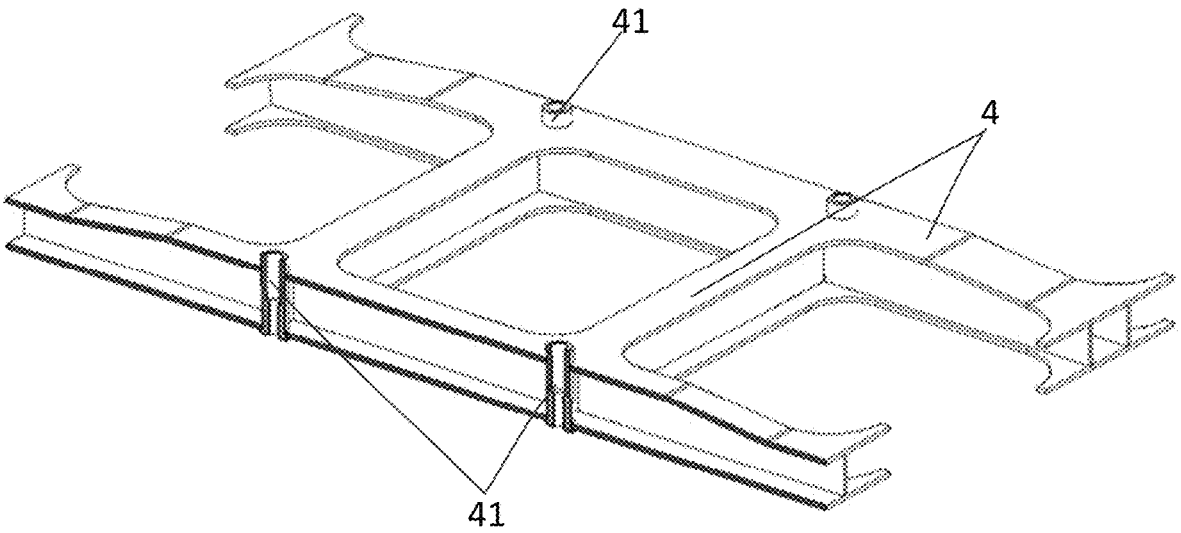
FIG. 4B is a sectional axonometric diagram of a bolster seam.
Figure 4C:
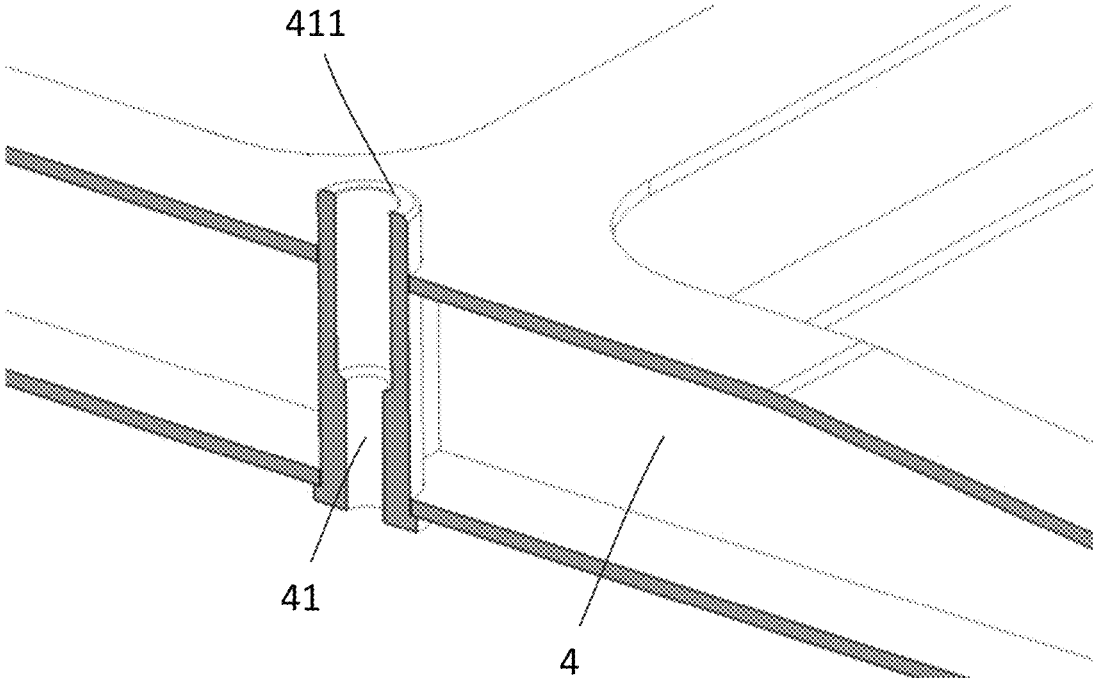
FIG. 4C is a partial cross-sectional diagram of a bolter seam and a coupling cylinder in cooperation.

FIG. 4B is a sectional axonometric diagram of the bolster seam 4, and FIG. 4C is a partial cross-sectional diagram of the bolter seam 4 and the coupling cylinder 41 in cooperation; an inner diameter of an upper part of the coupling cylinder 41 is relatively large, larger than the stud of the coupling bolt 52, which facilitates downward insertion. An inner diameter of a lower part of the coupling cylinder 41 is relatively small, and an internal thread is provided here for threaded connection with the stud of the coupling bolt 52.

Further, as shown in FIG. 4A, a top of the coupling cylinder 41 according to the present application is higher than an upper surface of the bolster seam 4; as shown in FIGS. 3B and 3C, a limit ring 311 protrudes downwardly around a through hole in a center at a bottom of the inner supporting member 31, and the limit ring 311 also protrudes downward from a lower contact surface 312. The limit ring 311 may be a whole ring or multiple split structures distributed in an annular shape. The limit ring 311 is configured to be inserted into the coupling cylinder 41, which limits circumferential positions of the damping unit 3 and the coupling cylinder 41, and avoids relative lateral stagger.

In order to further improve the assembly effect, the an upper contact surface 411 at the top of the coupling cylinder 41 and the lower contact surface 312 at the bottom of the inner supporting member 31 are mutually matched finishing surfaces, which ensures that the upper contact surface 411 and the lower contact surface 312 are level, and the two surfaces are in full contact when they are completely contacted, avoids relative movement of the inner supporting member 31 and the coupling cylinder 41, and ensures the coupling bolt 52 is in a vertical state after assembly. If the upper contact surface 411 and the lower contact surface 312 are uneven and move with each other, bending stress may be generated on the coupling bolt 52, and the arrangement of the finishing surface may reduce the possibility of bending stress.

The coupling cylinder 41 protrudes from the upper surface of the bolster seam 4. Only a pair of relative small contact surfaces of the upper contact surface 411 and the lower contact surface 312 is arranged. If the top of the coupling cylinder 41 is flush with the upper surface of the bolster seam 4, a lower surface of the connection base 2 cannot contact with the upper surface of the bolster seam 4. In order to avoid bending stress of the coupling bolt 52, a larger surface needs to be processed. Therefore, the present application adopts the configuration in which the coupling cylinder 41 protrudes upward, which may also reduce the processing complexity.

Preferably, in the present application, a distance between the upper surface of the bolster seam 4 and the lower surface of the connection base 2 is 5 mm to 10 mm, including an endpoint value, that is, the coupling cylinder 41 protrudes upward from the upper surface of the bolster seam 4 by substantially 5 mm to 10 mm; as shown in FIG. 3A, the coupling cylinder 41 is fixed to the bolster seam 4 by welding, and a bottom of an outer surface of the coupling cylinder 41 is arranged with an annular convex edge, and an outer diameter of the convex edge is greater than an outer diameter of a main body of the coupling cylinder 41, which may support an lower surface of the bolster seam 4. If the welding fails, that supporting by the convex edge may play a role of secondary protection.

Preferably, a limit platform protrudes downwardly from a middle of a bottom of the cover plate 51 according to the present application, and the limit platform is inserted into an inner cavity of the inner supporting member 31, and configured to contact an inner wall of the inner supporting member 31 for being restricted, which prevents the cover plate 51 from moving laterally, and avoids shearing force on the coupling bolt 52.

On the basis of any one of the above technical solutions and their mutual combinations, the intermediate buffer 32 according to the present application is in a shape of a cone, and the outer surface of the inner supporting member 31 and the inner surface of the outer supporting member 33 are tapered surfaces. Referring to FIGS. 3A to 3C for this structure, that is, inner and outer surfaces of the intermediate buffer 32 are both tapered surfaces, which are smooth transition structures, and a diameter of the intermediate buffer 32 gradually decreases from top to bottom, and the diameter change is smoothly transitioned. The outer surface of the inner supporting member 31 abut against the inner surface of the intermediate buffer 32, and is also a tapered surface, and the inner surface of the outer supporting member 33 abut against the outer surface of the intermediate buffer 32, and is also a tapered surface.

Preferably, the intermediate buffer 32 according to the present application is made of rubber, and the inner supporting member 31, the intermediate buffer 32 and the outer supporting member 33 are vulcanized into one body, and the entire damping unit 3 is a whole.

Figure 5:
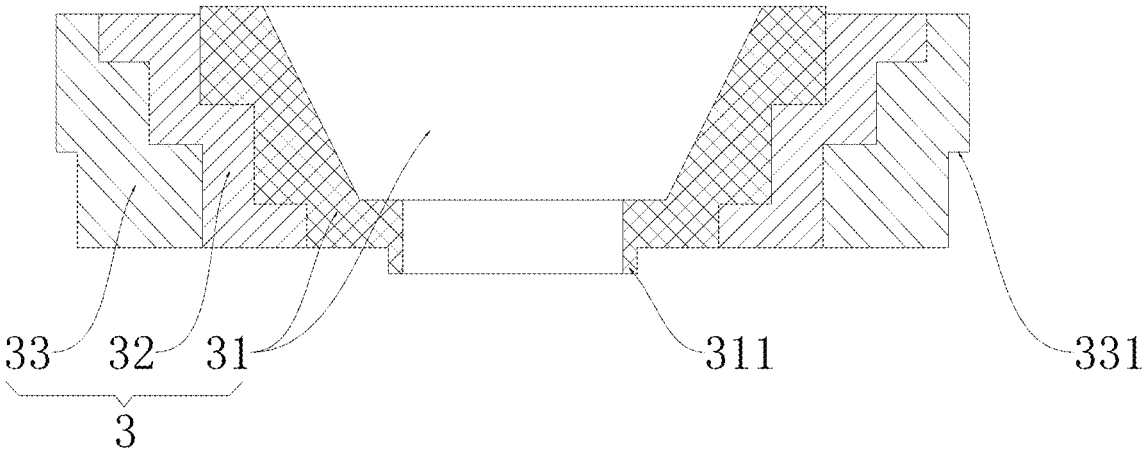
FIG. 5 is a front sectional diagram of another structure of a damping unit.

On the basis of any one of the above technical solutions and their mutual combinations, the present application provides another structure, as shown in FIG. 5. FIG. 5 is a front sectional diagram of another structure of the damping unit 3; the intermediate buffer 32 is in a shape of an annular step, and the diameter of the intermediate buffer 32 is gradually decreases from top to bottom, but the decrease is abrupt, and the overall trend is to shrink from top to bottom. Similarly, the outer surface of the inner supporting member 31 and the inner surface of the intermediate buffer 32 are step surfaces which are pressed tightly, and the inner surface of the outer supporting member 33 and the outer surface of the intermediate buffer 32 are step surfaces which are pressed tightly. The shapes of the inner surface of the inner supporting member 31 and the outer surface of the outer supporting member 33 may be arranged as required. As shown in FIG. 5, two stepped structures are provided, and more steps may be provided as required. These embodiments of the present application will not be repeated here.

The present application also provides a suspended monorail train, including the train suspension device according to any one of the above suspended monorail trains, and the suspended monorail train can achieve the same technical effect.

The above illustration of the disclosed embodiments can enable those skilled in the art to implement or use the present application. Various modifications to the embodiments are apparent to the person skilled in the art, and the general principle herein can be implemented in other embodiments without departing from the spirit or scope of the present application. Therefore, the present application is not limited to the embodiments described herein, but should be in accordance with the broadest scope consistent with the principle and novel features disclosed herein.

What is claimed is:

1. A train suspension device, comprising a hoisting rod and a connection base, wherein a top of the hoisting rod is connected to a bogie, and a bottom of the hoisting rod is arranged on the connection base;

a damping unit for connecting a bolster seam with the connection base comprises an inner supporting member, an intermediate buffer member and an outer supporting member which are nested successively from inside to outside, radial dimensions of an outer wall of the inner supporting member and an inner wall of the outer supporting member gradually decrease from one end to the other end in a vertical direction, and the intermediate buffer member, which is elastically deformable, is clamped between the inner supporting member and the outer supporting member;

one of the inner supporting member and the outer supporting member is connected to the connection base, and the other one of the inner supporting member and the outer supporting member is connected to the bolster seam, which makes the inner supporting member and the outer supporting member have a tendency of approaching each other, wherein a vertically through supporting hole is defined on the connection base, and the supporting hole limits the installation of the outer supporting member; the radial dimensions of the outer wall of the inner supporting member and the inner wall of the outer supporting member gradually decrease from top to bottom; the inner supporting member is fixed relative to the bolster seam.

2. The train suspension device according to claim 1, wherein an annular supporting plate is arranged at a bottom of the supporting hole, and the supporting plate supports the outer supporting member from the bottom of the outer supporting member.

3. The train suspension device according to claim 2, wherein an inner wall of the supporting hole is perpendicular to a horizontal plane; the inner wall of the supporting hole is provided with a supporting step, and the supporting step cooperates with and supports an outer step protruding from an outer surface of the outer supporting member.

4. The train suspension device according to claim 1, wherein a coupling cylinder is arranged on the bolster seam, and an internal thread is provided on an inner wall of the coupling cylinder, and the coupling cylinder is fixedly connected to the inner supporting member through a threaded connection.

5. The train suspension device according to claim 4, wherein a cover plate is arranged on and covers a top of the inner supporting member, and a coupling bolt penetrates a middle of the cover plate, and a stud of the coupling bolt is inserted into the internal thread of the coupling cylinder.

6. The train suspension device according to claim 5, wherein a top of the coupling cylinder is higher than an upper surface of the bolster seam, and a limit ring protrudes downwardly around a through hole in a center at a bottom of the inner supporting member, and the limit ring is configured to be inserted into the coupling cylinder;

an upper contact surface at the top of the coupling cylinder and a lower contact surface at the bottom of the inner supporting member are finishing surfaces which are mutually matched.

7. The train suspension device according to claim 6, wherein a distance between the upper surface of the bolster seam and a lower surface of the connection base is 5 mm to 10 mm; the coupling cylinder is fixed to the bolster seam by welding, and a bottom of an outer surface of the coupling cylinder is arranged with an annular convex edge, which supports a lower surface of the bolster seam.

8. The train suspension device according to claim 5, wherein a limit platform protrudes downwardly from a middle of a bottom of the cover plate, and the limit platform is inserted into an inner cavity of the inner supporting member, and configured to contact an inner wall of the inner supporting member for being restricted, which prevents the cover plate from moving laterally, and avoids shearing force on the coupling bolt.

9. The train suspension device according to claim 1, wherein the intermediate buffer is in a shape of a cone, and the outer surface of the inner supporting member and the inner surface of the outer supporting member are tapered surfaces.

10. The train suspension device according to claim 9, wherein the intermediate buffer is made of rubber, and the inner supporting member, the intermediate buffer and the outer supporting member are vulcanized into one body.

11. The train suspension device according to claim 1, wherein the intermediate buffer is in a shape of an annular step, and the outer surface of the inner supporting member and the inner surface of the outer supporting member are step surfaces which are pressed tightly with the intermediate buffer.

12. A suspended monorail train, comprising the train suspension device according to claim 1.

* * * * *